US005246169A

United States Patent [19]

Heimann et al.

[11] Patent Number: 5,246,169

[45] Date of Patent: Sep. 21, 1993

[54] SHOWER HEAD

[75] Inventors: Bruno Heimann, Fröndenberg-Ardey; Hans-Joachim Rapp, Hagen, both of Fed. Rep. of Germany

[73] Assignee: Friedrich Grohe Aktiengesellschaft, Hemer, Fed. Rep. of Germany

[21] Appl. No.: 883,834

[22] Filed: May 15, 1992

[30] Foreign Application Priority Data

May 24, 1991 [DE] Fed. Rep. of Germany ..... 4116930

[51] Int. Cl.[5] ..... B05B 1/16; B05B 1/18

[52] U.S. Cl. ..... 239/447; 239/381; 239/562

[58] Field of Search ..... 239/443, 444, 446–449, 239/436, 394, 558, 559, 553–553.5, 381, 562

[56] References Cited

U.S. PATENT DOCUMENTS 4,754,928 7/1988 Rogers et al. ..... 239/447

FOREIGN PATENT DOCUMENTS 348359 12/1989 European Pat. Off. ..... 239/447
3706320 3/1988 Fed. Rep. of Germany ..... 239/447
8804236 7/1988 Fed. Rep. of Germany .
2378567 8/1978 France .

*Primary Examiner*—Andres Kashnikow
*Assistant Examiner*—Karen B. Merritt
*Attorney, Agent, or Firm*—Herbert Dubno; Andrew Wilford

[57] ABSTRACT

A shower head has a housing having an end wall provided with a plurality of sets of spray nozzles, a partition element defining in the housing a pressurizable inlet chamber and formed offset from the axis with an axially throughgoing outlet hole, and a valve element rotatable in the housing on the partition about the axis, overlying the outlet hole, and formed offset from the axis with a plurality of axially throughgoing apertures radially equispaced from the axis and angularly spaced thereabout, selectively alignable with the partition hole, and each associated with a respective set of the nozzles. The housing also is formed with respective passages connecting the apertures with the respective sets of nozzles. One of the elements is provided with a restriction formation for progressive restriction of the outlet hole from a fully open to fully closed condition on rotation of the valve element through a predetermined angular stroke.

10 Claims, 4 Drawing Sheets

SHOWER HEAD

FIELD OF THE INVENTION

The present invention relates to a shower head. More particularly this invention concerns a shower head normally used on a hand-type shower connected via a flexible hose to the water supply.

BACKGROUND OF THE INVENTION

A standard shower head is known having an adjustment ring that can be turned to vary the flow from the shower head. The ring can vary volume or even switch the shower head between different spray modes, for instance concentrating flow from a single central large-diameter port or from an array of peripheral small-diameter ports.

In German patent 3,047,336 filed 24 Jun. 1982 by G. Kottek such a system is shown having inlet ports from which flow can be directed to a central large-diameter massage port or to peripheral smaller-diameter shower ports. An axially displaceable piston in the shower head can move a seal past the inlet ports to divert the flow as desired, and can even move over the inlet ports to provide some flow control to the shower ports.

Such a system is fairly bulky, in particular in the axial direction. It is therefore not readily adaptable for use in a hand-type shower. Furthermore the adjustment only basically allows two modes of operation.

OBJECTS OF THE INVENTION

It is therefore an object of the present invention to provide an improved shower head.

Another object is the provision of such an improved shower head which overcomes the above-given disadvantages, that is which is axially very compact and that can also operate in more than two different flow modes.

SUMMARY OF THE INVENTION

A shower head according to the invention has a housing having an end wall provided with a plurality of sets of spray nozzles, a partition element defining in the housing a pressurizable inlet chamber and formed offset from the axis with an axially throughgoing outlet hole, and a valve element rotatable in the housing on the partition about the axis, overlying the outlet hole, and formed offset from the axis with a plurality of axially throughgoing apertures radially equispaced from the axis and angularly spaced thereabout, selectively alignable with the partition hole, and each associated with a respective set of the nozzles. The housing also is formed with respective passages connecting the apertures with the respective sets of nozzles. One of the elements is provided with a restriction formation for progressive restriction of the outlet hole from a fully open to fully closed condition on rotation of the valve element through a predetermined angular stroke.

With this arrangement it is therefore possible to make the shower head a relatively flat disk-shaped unit. Since the openings for selecting the various flow modes can be spread out over a relatively large diameter, it is possible not only to have a plurality of different settings, but to have a wide angle of adjustment to vary flow volume for fine control. At the same time the control or valve element can be produced fairly cheaply by molding.

In accordance with another feature of the invention the outlet hole and the apertures are of such angular extent that in any position of the valve element at least one of the apertures is at least partially aligned with and in fluid communication with the outlet hole. This means that the main chamber of the shower head will never be subjected to full line pressure, making it possible to design it fairly light.

One of the apertures in accordance with this invention is formed on a face of the valve element turned toward the partition with angled flanks constituting the restriction formation. The angled flanks have a depth at an edge of the respective aperture that is equal to about three-tenths of an angular width of the respective aperture. In addition they have opposite edges spaced apart by about 90° relative to the axis.

In another system of this invention the valve element has a lobe forming the aperture and a part-spiral outer edge constituting the restriction formation. Thus the variable-flow aperture in this system is actually the empty space formed outside the part-spiral edge. The lobe is displaceable between 40° and 90°, preferably 60°, between a position fully blocking the outlet hole and a position fully exposing same.

Furthermore in accordance with this invention the outlet hole is angularly elongated. The valve element is formed with four such apertures two of which are diametrically across from each other and provided with the restriction formations. In addition at least one of the apertures is angularly elongated and has a periphery provided with an O-ring engaging the partition.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

DESCRIPTION

Figure 1:
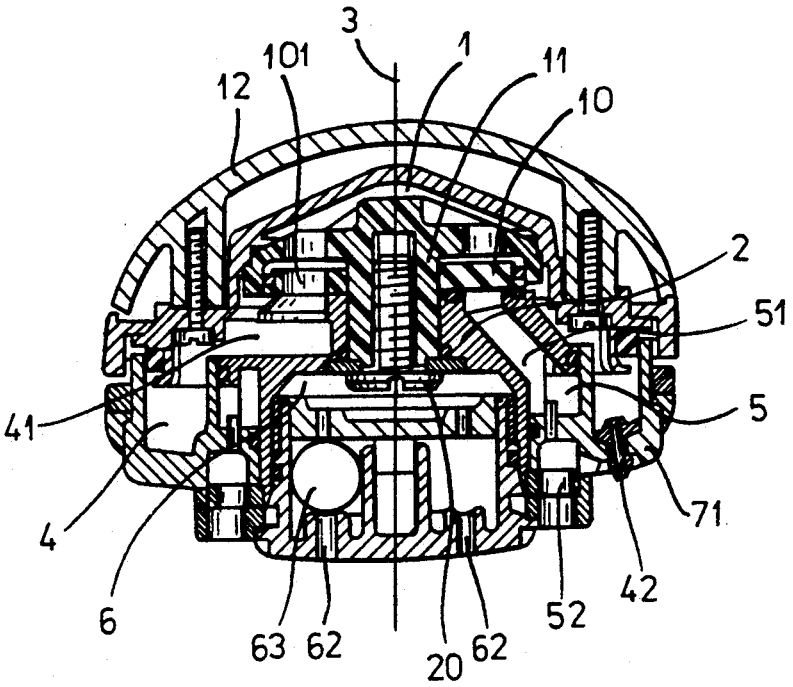
FIG. 1 is an axial section through a shower head according to the invention.

As seen in FIGS. 1 through 9 a shower head according to the invention has a housing 12 which here is the head end of a hand- or telephone-type shower but which could also be a standard pipe-mounted stationary shower head. The housing 12 forms an inlet chamber 1 centered on an axis 3 along which extends a stem 11 on which is mounted an elastomeric but nonrotatable partition disk 10 formed with a single throughgoing hole 101 of elliptical shape centered on a circle 102 centered on the axis 3. Rotatable on the stem 11 in front of the disk 10 is a valve element 2 that is part of a front wall 71 of the housing 12 that is held together by a screw 20. This valve element 2 is formed centered on the circle 102 with four angularly equispaced holes including two diametrically opposite elliptical and axially throughgoing apertures 23 and 24 and two interleaved and diametrically opposite radially outwardly open and axially throughgoing apertures or notches 22. Each aperture 23 and 24 is surrounded by a respective O-ring 26 set in a respective groove 25.

The valve element 2 is provided on the outer periphery of the front end wall 71 with an array of small full-flow nozzles 42 whose rear ends are supplied from an annular chamber 4 connected via a passage 41 to the notches 22. The rear face of the element 2 is formed to each side of each notch 22 with an angled surface 21. Each notch 22 and the respective angled surfaces 21 extend over about 90° relative to the axis 3.

Inward of the nozzles 42 the front wall 71 is provided with nozzle openings 52 opening into an annular chamber 5 connected via a passage 51 to the aperture 23. The chamber 5 is set up so that when it is pressurized the nozzles 42 will provide bubble or so-called champagne flow.

Near the center of the front wall 71 is a small circular array of nozzles 62 opening into a chamber 6 connected via a passage 61 to the aperture 24. Elements 63 in the chamber 6 are provided to ensure that flow from the holes 62 will pulsate in the manner well known in the art.

Figure 2:
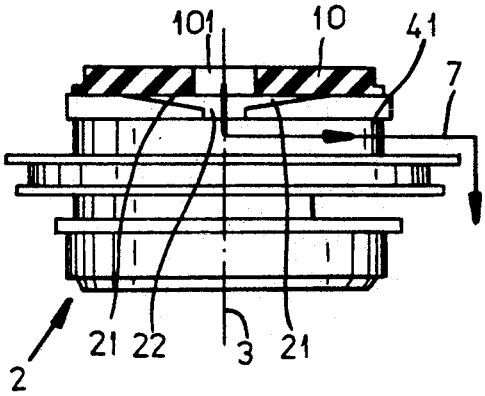
FIG. 2 is a side view partly in axial section through a detail of the invention in the full-flow normal-spray setting.
Figure 3:
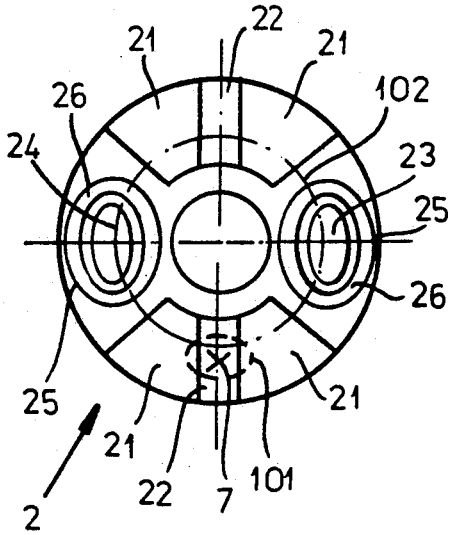
FIG. 3 is a top view of the structure of FIG. 2.

The device described above operates as follows:

For full flow from the standard full-flow nozzles 42 the element 2 is set in the position of FIGS. 2 and 3 with one of the notches 22 directly axially aligned with the partition hole 101. Water passes in a flow 7 from the chamber 1 through the hole 101 into the notch 22 and thence via the passage 41 to the chamber 4. The water exits from the nozzles 42 as standard solid streams.

Figure 4:
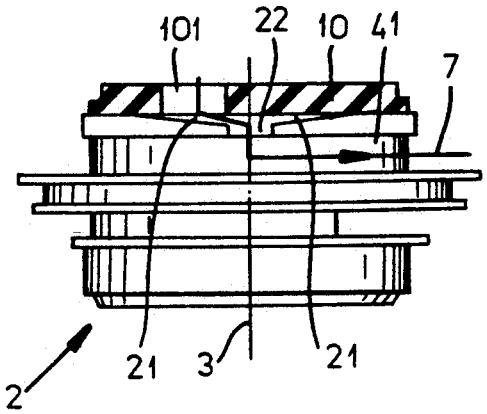
FIG. 4 is a side view partly in axial section through a detail of the invention in the partial-flow normal-spray setting.
Figure 5:
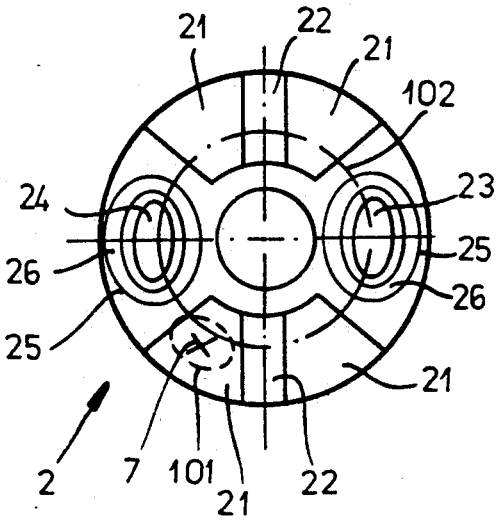
FIG. 5 is a top view of the structure of FIG. 4.

For controlled or restricted flow from the nozzles 42 the body 2 can be angularly offset as indicated in FIGS. 4 and 5 so that the surfaces 21 restrict the flow 7 while still allowing it through to the nozzles 42. The angular extent of such restriction is 45°. from fully open to fully closed so that one has a relatively fine control over the device.

Figure 6:
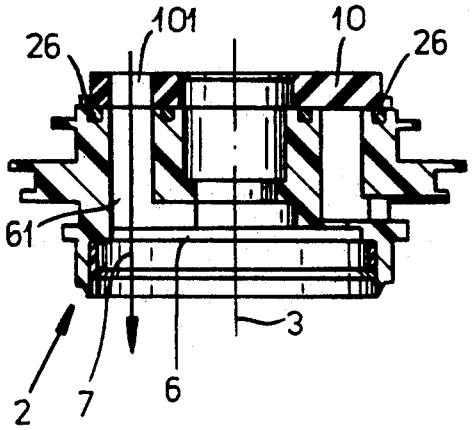
FIG. 6 is a side view partly in axial section through a detail of the invention in the bubble spray setting.
Figure 7:
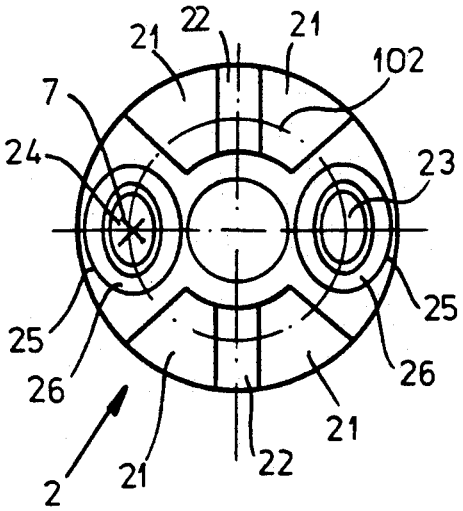
FIG. 7 is a top view of the structure of FIG. 6.

For pulsating spray from the orifices 62 as shown in FIGS. 6 and 7 the housing part 2 is rotated so that the hole 24 is aligned with the hole 101, thereby feeding water to the chamber 6 via the passage 61.

Figure 8:
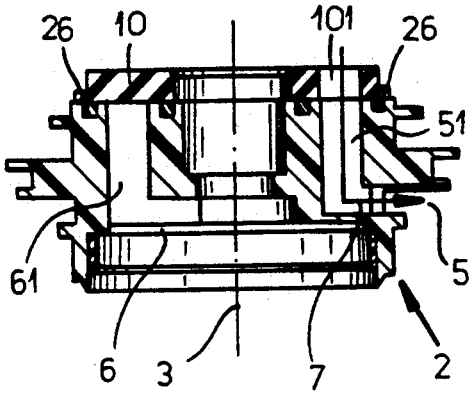
FIG. 8 is a side view partly in axial section through a detail of the invention in the massage spray setting.
Figure 9:
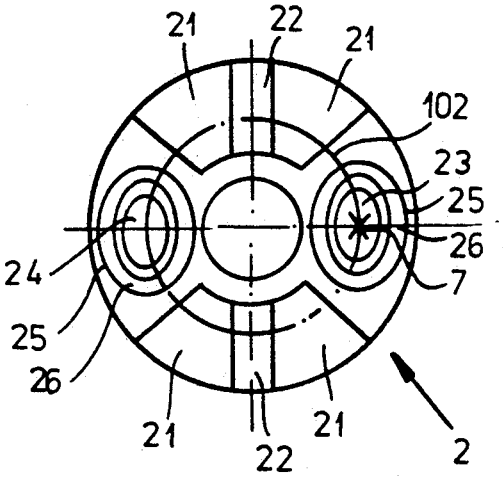
FIG. 9 is a top view of the structure of FIG. 8.
Figure 12:
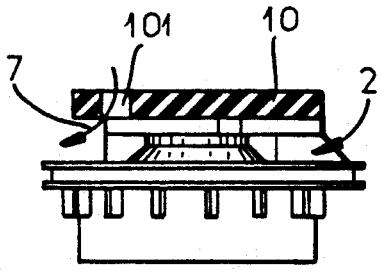
FIG. 12 is a view like FIG. 4 of an alternative arrangement according to the invention in the partial-flow normal-spray position.
Figure 10:
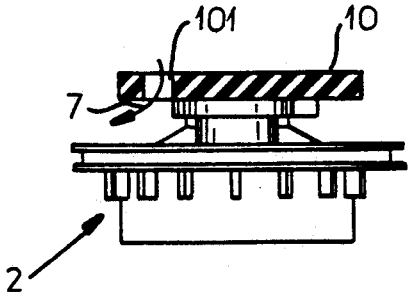
FIG. 10 is a view like FIG. 2 of an alternative arrangement according to the invention in the full-flow normal-spray position.
Figure 13:
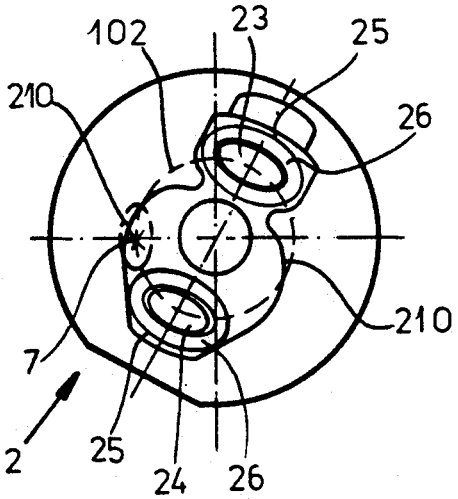
FIG. 13 is a top view of the structure of FIG. 12.
Figure 11:
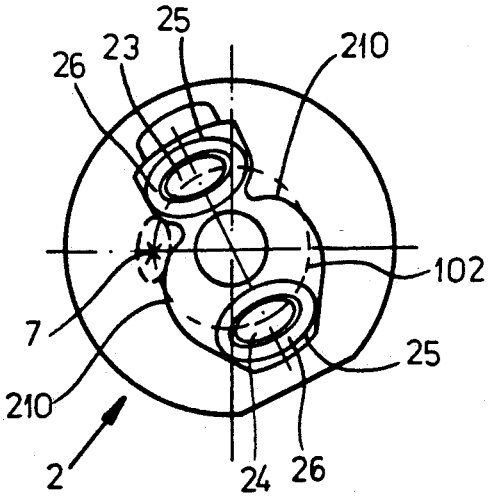
FIG. 11 is a top view of the structure of FIG. 10.

To get bubble spray from the holes 52 the aperture 23 is aligned with the hole 101 as shown in FIGS. 8 and 9. This allows flow through the passage 51 to the chamber 5 so it can mix with air and exit via the nozzles 52.

The angular spacings of the outer edges of the flank surfaces 21 and of the edges of the apertures 23 and 24 are slightly less than the angular extent of the hole 101 so that at all times there is some flow through the hole 101. This prevents excessive pressure from building up in the chamber 1 and generally makes switching from one mode to the other very smooth.

FIGS. 10 through 13 show another arrangement where instead of notches 22 with flank surfaces 21 the element 2 has two lobes 210 forming edges that extend as part spirals that cross the circle 102. Thus as the element 2 is rotated one of its lobes 210 can incrementally block the hole 101 to restrict flow through it. Once again the dimensions of the various apertures 23 and 24 and of the lobes 210 are such that there is always some flow through the shower head.

We claim:

1. A shower head comprising:

a housing having an end wall provided with a plurality of sets of spray nozzles;

a partition element defining in the housing a pressurizable inlet chamber and formed offset from the axis with an axially throughgoing outlet hole;

a valve element rotatable in the housing on the partition about the axis, overlying the outlet hole, and formed offset from the axis with a plurality of axially throughgoing apertures radially equispaced from the axis and angularly spaced thereabout, selectively alignable with the outlet hole, and each associated with a respective set of the nozzles, the housing also being formed with respective passages connecting the apertures with the respective sets of nozzles, the outlet hole and the apertures being of such angular extent that in any position of the valve element at least one of the apertures is at least partially aligned with and in fluid communication with the outlet hole; and means including a restriction formation on one of the elements for progressive restriction of the outlet hole from a fully open to fully closed condition on rotation of the valve element through a predetermined angular stroke.

2. The shower head defined in claim 1 wherein one of the apertures is formed on a face of the valve element turned toward the partition with angled flanks constituting the restriction formation.

3. The shower head defined in claim 2 wherein the angled flanks have a depth at an edge of the respective aperture that is equal to about three-tenths of an angular width of the respective aperture.

4. The shower head defined in claim 2 wherein the angled flanks have opposite edges spaced apart by about 90° relative to the axis.

5. The shower head defined in claim 1 wherein the valve element has a lobe forming one of the aperture and a part-spiral outer edge constituting the restriction formation.

6. The shower head defined in claim 5 wherein the lobe is displaceable between 40° and 90° between a position fully blocking the outlet hole and a position fully exposing same.

7. The shower head defined in claim 1 wherein the outlet hole is angularly elongated.

8. The shower head defined in claim 1 wherein the valve element is formed with four such apertures two of which are diametrically across from each other and provided with the restriction formation.

9. The shower head defined in claim 1 wherein at least one of the apertures is angularly elongated and has a periphery provided with an O-ring engaging the partition.

10. A shower head comprising:

a housing having an end wall provided with a plurality of sets of spray nozzles;

a partition element defining in the housing a pressurizable inlet chamber and formed offset from the axis with an axially throughgoing outlet hole; and a valve element rotatable in the housing on the partition about the axis, overlying the outlet hole, and formed offset from the axis with a plurality of axially throughgoing apertures radially equispaced from the axis and angularly spaced thereabout, selectively alignable with the outlet hole, and each associated with a respective set of the nozzles, the housing also being formed with respective passages connecting the apertures with the respective sets of nozzles, the apertures and hole being of such angular dimensions that in any angular position of the valve element the outlet hole axially at least partially overlaps at least one of the apertures.

* * * * *